US012150530B2

(12) United States Patent
Maruyama

(10) Patent No.: US 12,150,530 B2
(45) Date of Patent: Nov. 26, 2024

(54) STRAP AND WATCH

(71) Applicant: Seiko Epson Corporation, Tokyo (JP)

(72) Inventor: Yohei Maruyama, Matsumoto (JP)

(73) Assignee: SEIKO EPSON CORPORATION (JP)

( * ) Notice: Subject to any disclaimer, the term of this patent is extended or adjusted under 35 U.S.C. 154(b) by 503 days.

(21) Appl. No.: 17/483,849

(22) Filed: Sep. 24, 2021

(65) Prior Publication Data

US 2022/0095750 A1 Mar. 31, 2022

(30) Foreign Application Priority Data

Sep. 25, 2020 (JP) ..... 2020-161004

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/142; A44C 11/002; G04B 37/1486
See application file for complete search history.

(56) References Cited

U.S. PATENT DOCUMENTS 1,672,025 A * 6/1928 Grassman ..... A44C 5/14 24/906
3,247,560 A * 4/1966 Speranza ..... A44C 5/185 24/265 R
3,247,561 A * 4/1966 Speranza ..... A44C 5/185 24/265 R
5,331,610 A 7/1994 Kikuchi
2011/0197400 A1 8/2011 Chevrolet
2018/0125179 A1 5/2018 Giles
2021/0169182 A1* 6/2021 Yamashita ..... A44C 5/105

FOREIGN PATENT DOCUMENTS

JP H05-60305 A 3/1993
JP H07-012993 A 1/1995
JP 2002-357675 A 12/2002
JP 3116218 U 12/2005
JP 2019-535348 A 12/2019

OTHER PUBLICATIONS

English Translation JP H712993u (Year: 2024).*

* cited by examiner

*Primary Examiner* — Robert Sandy
*Assistant Examiner* — Michael S Lee
(74) *Attorney, Agent, or Firm* — Harness, Dickey & Pierce, P.L.C.

(57) ABSTRACT

A strap of the present disclosure includes a spring rod that includes a shaft member, and a strap main body that includes a plurality of decorative members coupled to each other and a connecting ring coupled to an end portion of the plurality of decorative members. The strap further includes a coupler that includes a spring rod insertion hole through which the spring rod is inserted, a fixing member insertion hole, and a connecting ring arrangement portion in which the connecting ring is disposed and that can be coupled to a watch main body of a watch by the spring rod, and a fixing member that connects the strap main body and the coupler by being inserted through the fixing member insertion hole and the connecting ring.

13 Claims, 12 Drawing Sheets

STRAP AND WATCH

The present application is based on, and claims priority from JP Application Serial Number 2020-161004, filed Sep. 25, 2020, the disclosure of which is hereby incorporated by reference herein in its entirety.

BACKGROUND

1. Technical Field

The present disclosure relates to a strap and a watch.

2. Related Art

In JP-A-2002-357675, a strap is disclosed that is coupled to a watch main body of a wrist watch. In JP-A-2002-357675, the strap is constituted by inserting a wire through decorative members each constituted by a pearl or the like, a fixing member, and the like. Then, the strap is fixed by inserting the fixing member into a mounting hole provided in a strap mounting portion of the watch main body, and screwing an engaging member into a screw hole formed on the back side of the strap mounting portion.

In JP-A-2002-357675, since the strap mounting portion of the watch main body has a dedicated structure for coupling the strap constituted by the decorative members, there is a problem in that another strap cannot be coupled to the watch main body.

SUMMARY

A strap of the present disclosure includes a spring rod including a shaft member, a strap main body including a plurality of decorative members coupled to each other by a thread-like member and a connecting ring coupled to an end portion of the plurality of decorative members, a coupler including a spring rod insertion hole through which the spring rod is inserted, a fixing member insertion hole, and a connecting ring arrangement portion in which the connecting ring is disposed, and configured to be coupled, by the spring rod, to a watch main body of a watch, and a fixing member configured to connect the strap main body and the coupler by being inserted through the fixing member insertion hole and the connecting ring.

A watch of the present disclosure includes the strap.

DESCRIPTION OF EXEMPLARY EMBODIMENTS

First Embodiment

A watch 100 according to a first embodiment of the present disclosure will be described below with reference to the drawings.

Figure 1:
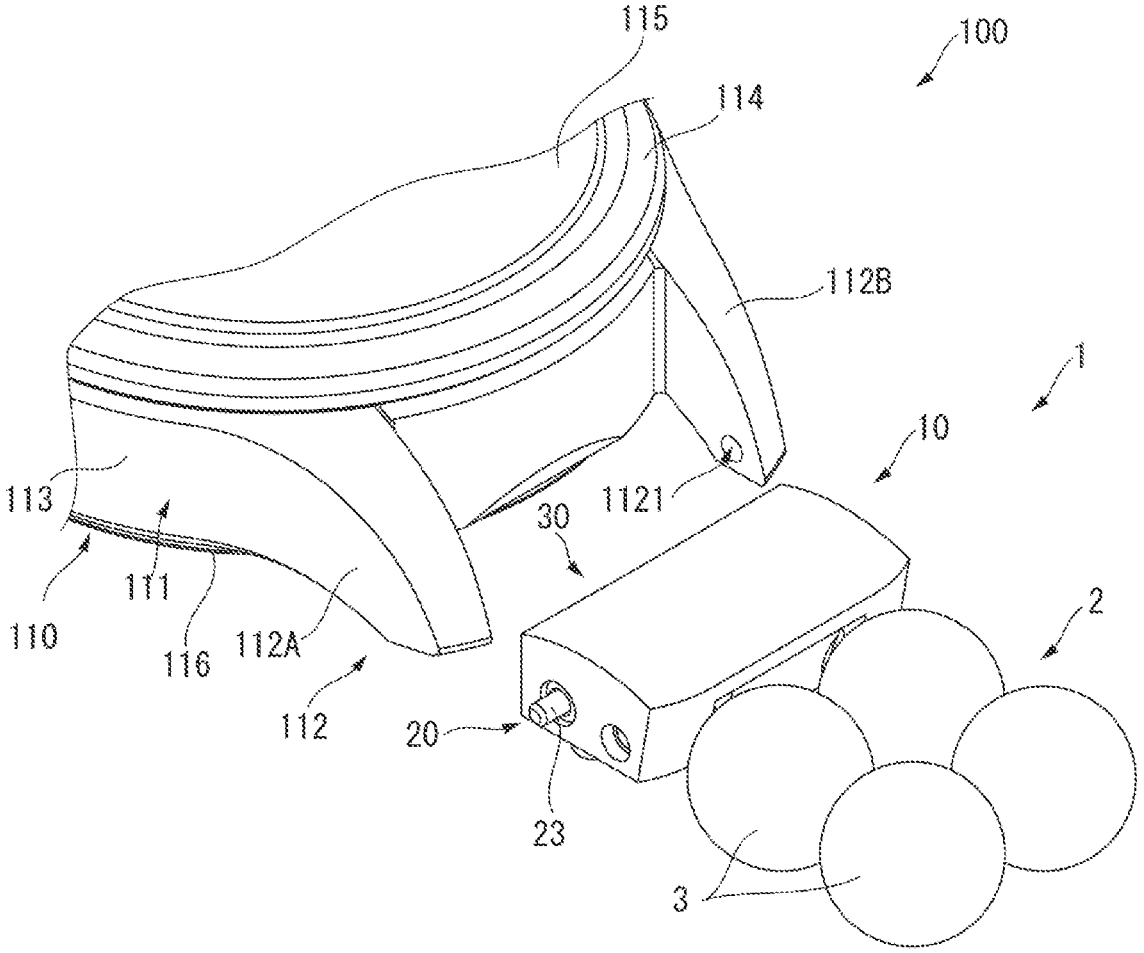
FIG. 1 is a perspective view illustrating main portions of a watch according to a first embodiment.

FIG. 1 is a perspective view illustrating main portions of the watch 100 according to the first embodiment.

As illustrated in FIG. 1, the watch 100 includes a watch main body 110 and a strap 1.

The watch main body 110 includes a case 111 and bows 112.

The case 111 includes a case body 113, a bezel 114, a cover glass 115, and a case back 116.

The case body 113 is a cylindrical member formed of metal, and a dial, a movement, and the like (not illustrated) are disposed inside the case body 113.

The bezel 114 is an annular member formed of metal and disposed on an upper portion of the case body 113. The cover glass 115 is disposed so as to cover an opening on the upper side of the case body 113, is fixed by the bezel 114, and covers the dial (not illustrated). The case back 116 is a member formed of metal, and is disposed so as to cover an opening on the lower side of the case body 113.

The bows 112 are provided in the 6 o'clock direction and the 12 o'clock direction of the case body 113, respectively. Then, each of the bows 112 includes a pair of holding piece portions 112A, 112B provided so as to protrude from side surfaces of the case body 113. Each of the holding piece portions 112A, 112B is provided with a hole portion 1121 into which a protruding member 23, 24 of a spring rod 20, which will be described below, is inserted.

Strap

Figure 2:
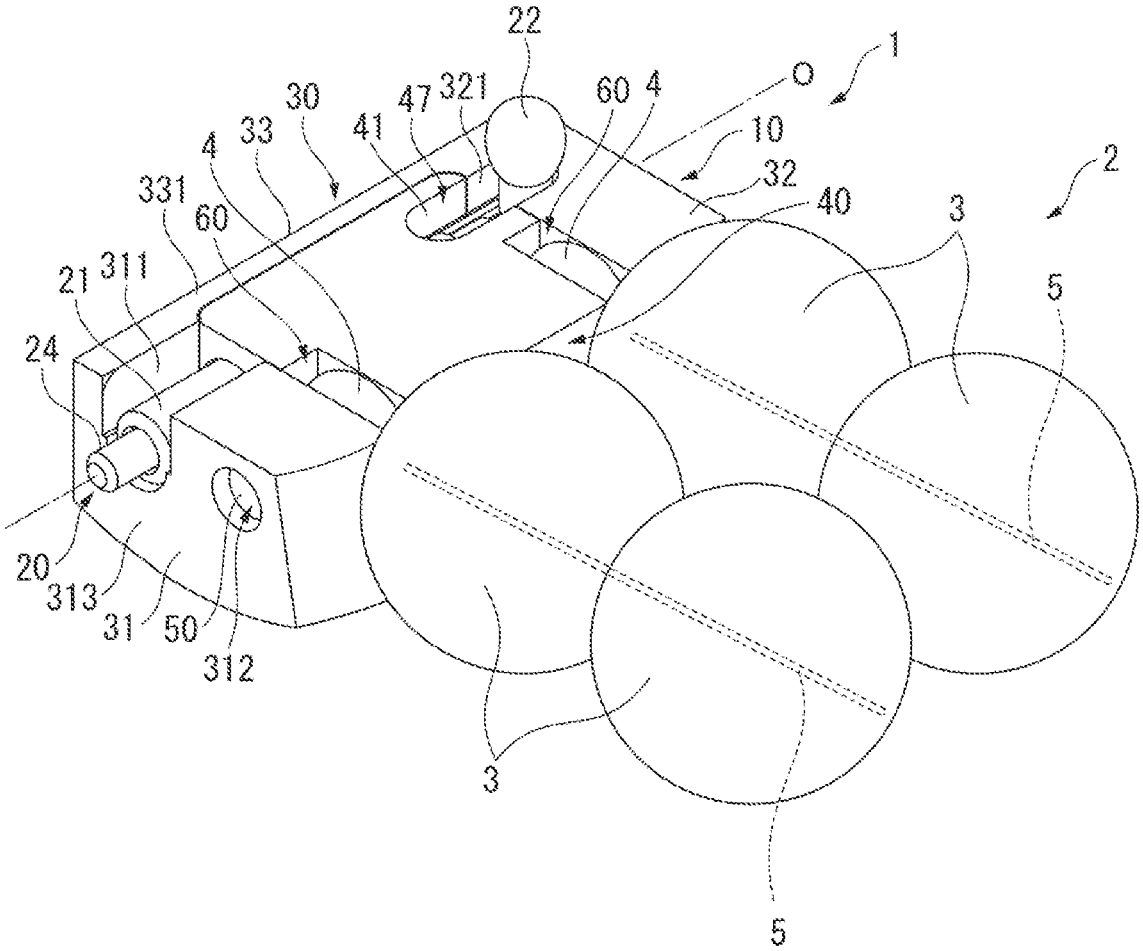
FIG. 2 is a perspective view illustrating a strap according to the first embodiment.
Figure 3:
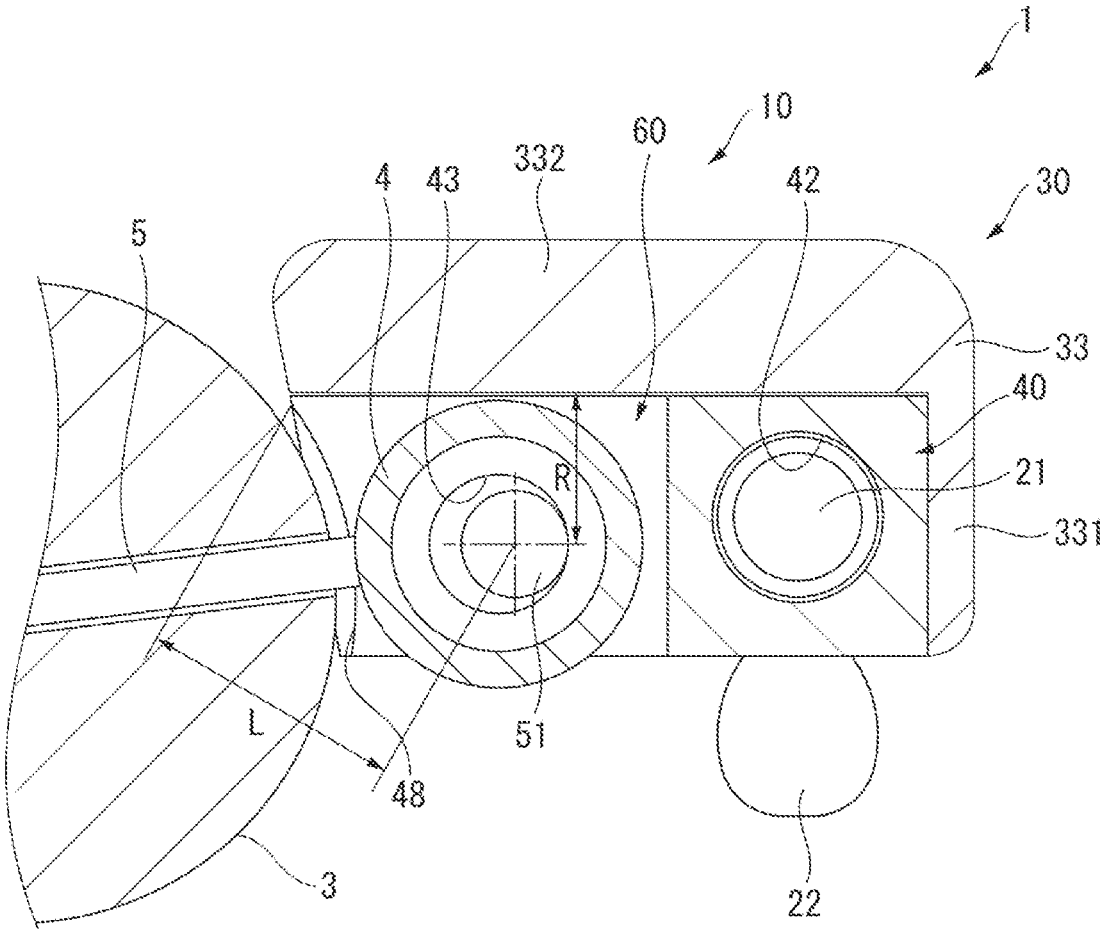
FIG. 3 is a cross-sectional view illustrating the strap according to the first embodiment.
Figure 4:
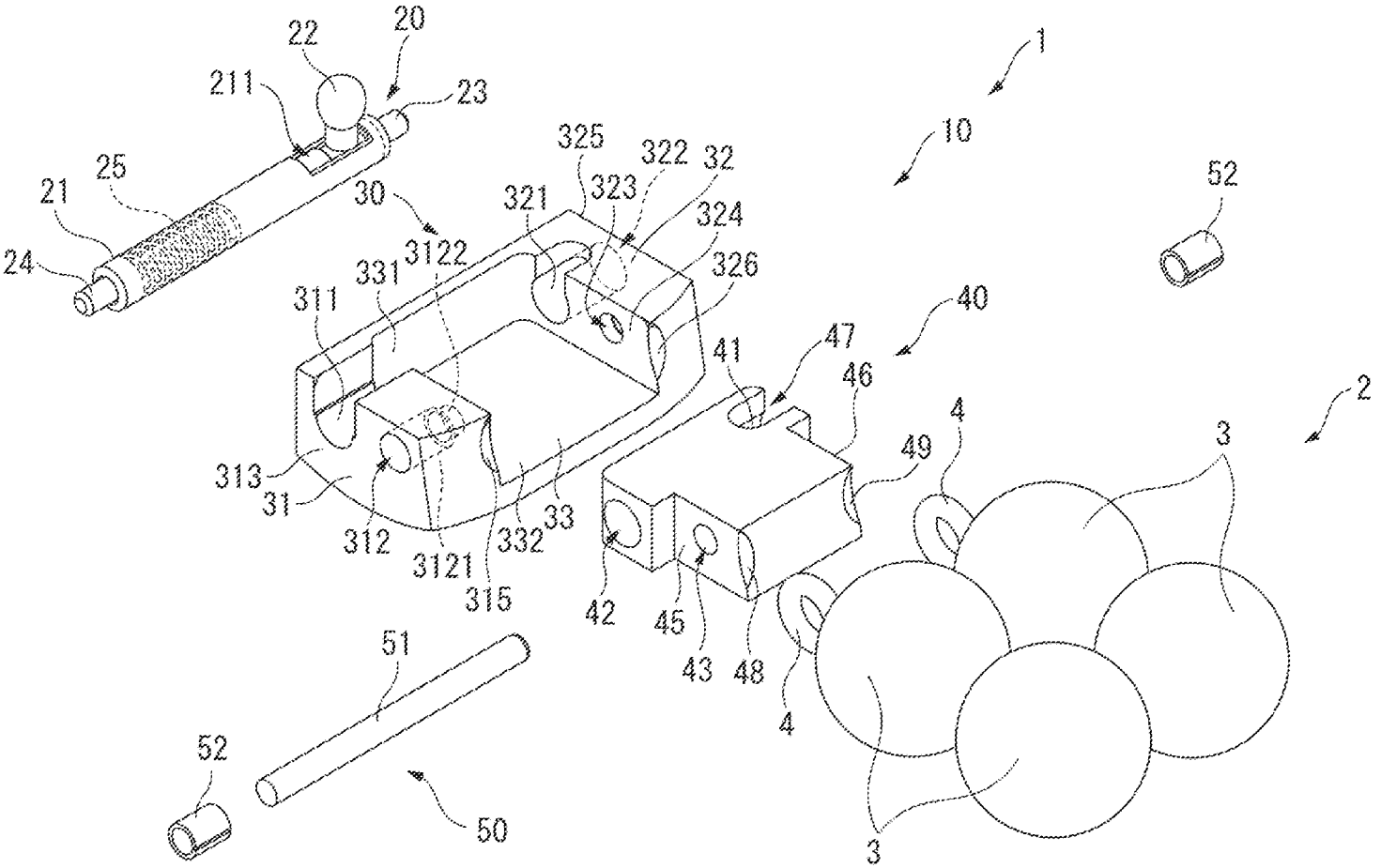
FIG. 4 is an exploded perspective view illustrating a coupler according to the first embodiment.
Figure 5:
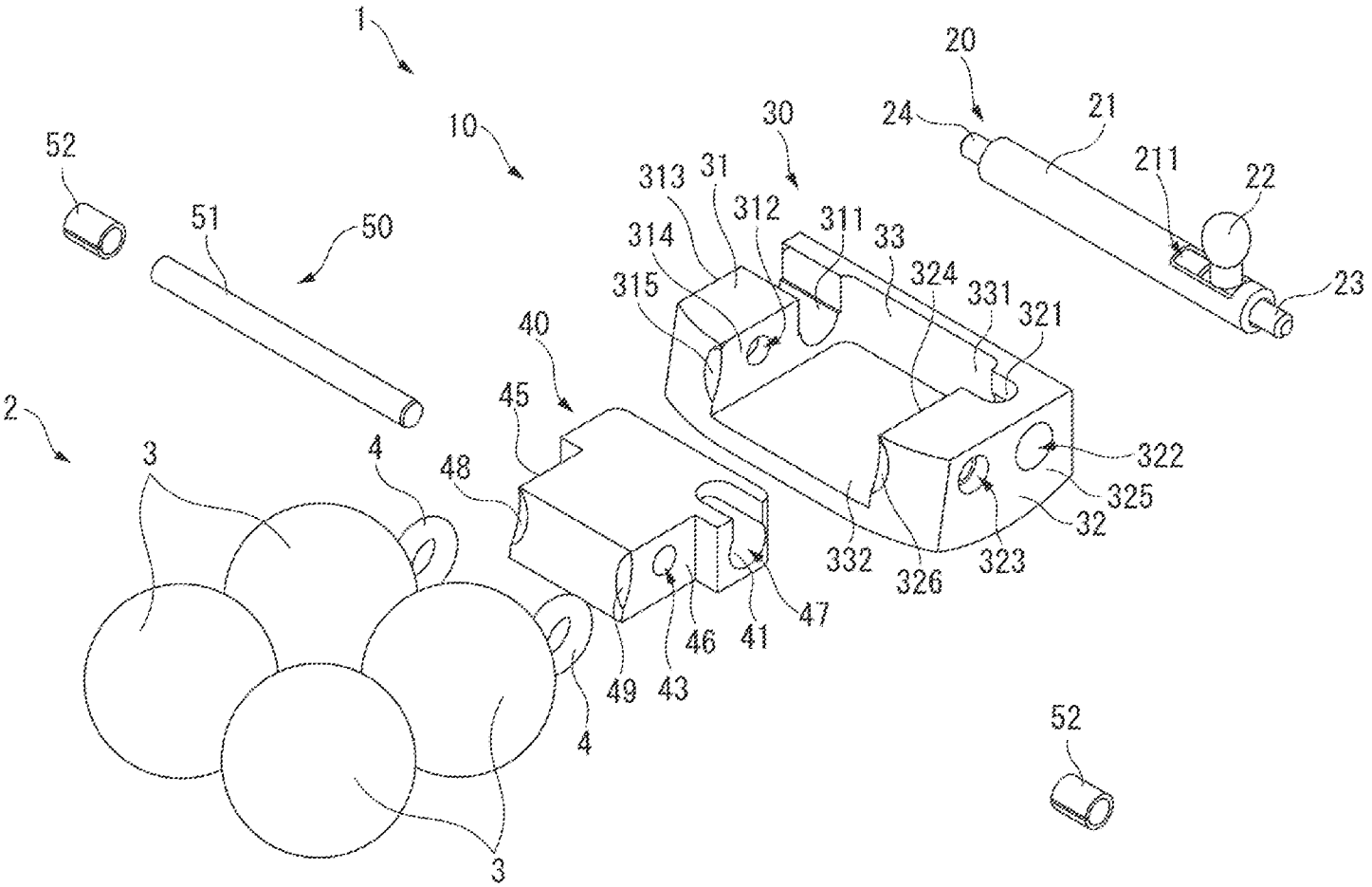
FIG. 5 is an exploded perspective view illustrating the coupler according to the first embodiment.

FIG. 2 is a perspective view illustrating the strap 1, FIG. 3 is a cross-sectional view illustrating the strap 1, and FIG. 4 and FIG. 5 are exploded perspective views illustrating a coupler 10. Note that in FIG. 4 and FIG. 5, the coupler 10 is viewed from different directions. Further, the coupler 10 is a so-called end-piece for attaching the strap 1 to the watch main body 110.

As illustrated in FIGS. 1 to 5, the strap 1 includes a strap main body 2, and the coupler 10 that is coupled to both end portions of the strap main body 2 and attached to the pair of holding piece portions 112A and 112B. Note that FIG. 1 illustrates only the coupler 10 attached to the holding piece portions 112A, 112B in the 6 o'clock direction of the watch 100.

Strap Main Body

The strap main body 2 is a main body portion of the strap 1 wound around an arm of a user, and includes a plurality of decorative members 3, connecting rings 4, and wires 5.

The decorative member 3 is constituted by a pearl, and the plurality of decorative members 3 are coupled to each other as a result of the wire 5 constituted by a piano wire or the like being inserted through a through hole provided in each of the pearls. In this embodiment, the decorative members 3 are coupled to each other by the wires 5, so that the decorative members 3 are arranged in two rows. As a result, the highly decorative strap 1 is configured. Note that the decorative member 3 is not limited to the configuration described above, and may be constituted by a jewel such as an opal, an agate, a ruby, and a diamond, a shell of a white-lipped pearl oyster, a black-lipped pearl oyster, or the like, or wood or the like, for example. Further, as long as the wire 5 has a thread-like shape and is capable of coupling the decorative members 3 to each other, the wire 5 may be constituted by a synthetic fiber such as nylon, or a silk thread, in addition to the piano wire.

The connecting rings 4 are each formed of a material such as metal in an annular shape, and coupled to both end portions of the decorative members 3 by the wires 5, for example, as a result of tying the wires 5 to the connecting rings 4. Specifically, two of the connecting rings 4 are coupled to one of the end portions of the strap main body 2, and two of the connecting rings 4 are coupled to the other end portion of the strap main body 2. Then, in this embodiment, the connecting rings 4 are disposed in connecting ring arrangement portions 60 of the coupler 10, which will be described below, and are coupled to the coupler 10 by a fixing member 50, which will be described below. As a result, the strap main body 2 and the coupler 10 are coupled to each other. Note that the connecting ring 4 may be formed of another material in an annular shape, or may be formed integrally with the wire 5 by tying the wire 5 into an annular shape.

Coupler

The coupler 10 includes the spring rod 20, an outer block 30, an inner block 40, the fixing member 50, and the connecting ring arrangement portions 60.

Spring Rod

The spring rod 20 is a member for detachably coupling the coupler 10 to the pair of holding piece portions 112A, 112B. In this embodiment, the spring rod 20 includes a shaft member 21, an operating portion 22, a first protruding member 23, a second protruding member 24, and a spring member 25. Further, the spring rod 20 is inserted through a first arm recessed portion 311, an inner block insertion hole 42, an inner block recessed portion 41, a second arm recessed portion 321, and a second arm insertion hole 322, all of which will be described below.

Note that the inner block insertion hole 42 and the second arm insertion hole 322 configure a spring rod insertion hole of the present disclosure through which the spring rod 20 is inserted.

The shaft member 21 is formed of metal and has a cylindrical shape, and an opening is provided at each of first and second end portions thereof. Then, a long hole 211 is provided in the outer circumferential surface of the shaft member 21. Note that the length of the shaft member 21 is configured to be substantially equal to a length in the width direction of the outer block 30, that is, a length from a first side surface 313 of a first arm portion 31 to a second side surface 325 of a second arm portion 32, which will be described below.

The operating portion 22 is provided so as to protrude from the first protruding member 23 in a direction orthogonal to an axial direction O of the shaft member 21, and protrudes from the long hole 211 of the shaft member 21. In this embodiment, the operating portion 22 is integrally provided with the first protruding member 23. Then, the operating portion 22 is configured to be movable inside the long hole 211 along the axial direction O. As a result, the first protruding member 23 integrally provided with the operating portion 22 can be moved along the axial direction O, and thus, the coupler 10 can be attached to and removed from the bows 112 of the watch 100. In other words, the long hole 211 is provided having the length such that the first protruding member 23 becomes detached from the hole portion 1121 of the bow 112 when the operating portion 22 is moved along the axial direction O. Note that the axial direction O is a direction orthogonal to a direction in which the strap main body 2 of the strap 1 extends.

Further, when the spring rod 20 is housed in the outer block 30 and the inner block 40, the operating portion 22 is disposed so as to protrude from an opening 47 of the inner block recessed portion 41, which will be described below. As a result, the operating portion 22 is configured to be movable inside the inner block recessed portion 41 and the second arm recessed portion 321 along the axial direction O of the shaft member 21, when the spring rod 20 is housed in the outer block 30 and the inner block 40.

A base end portion of the first protruding member 23 has a large diameter and is housed inside the shaft member 21. Then, a tip portion of the first protruding member 23 having a small diameter protrudes, along the axial direction O, from the opening provided at the first end portion of the shaft member 21.

Further, the first protruding member 23 is urged by the spring member 25 so that the tip portion thereof protrudes along the axial direction O of the shaft member 21. At this time, the first protruding member 23 is in a state in which the base end portion having the large diameter is engaged with the first end portion of the shaft member 21.

Furthermore, the first protruding member 23 is disposed so that the tip portion thereof protrudes from the outer block 30 along the axial direction O, when the spring rod 20 is housed in the outer block 30 and the inner block 40.

A base end portion of the second protruding member 24 has a large diameter and is housed inside the shaft member 21. Then, a tip portion of the second protruding member 24 having a small diameter protrudes, along the axial direction O, from the opening provided at the second end portion of the shaft member 21.

Further, the second protruding member 24 is urged by the spring member 25 so that the tip portion thereof protrudes along the axial direction O of the shaft member 21. At this time, the second protruding member 24 is in a state in which the base end portion having the large diameter is engaged with the second end portion of the shaft member 21.

Furthermore, the first protruding member 24 is disposed so that the tip portion thereof protrudes from the outer block 30, when the spring rod 20 is housed in the outer block 30 and the inner block 40. Note that the first protruding member 23 and the second protruding member 24 are examples of a protruding member of the present disclosure.

The spring member 25 is a so-called coil spring and is housed inside the shaft member 21. Then, the spring member 25 is in contact with an end portion on the base end side of the first protruding member 23 and an end portion on the base end side of the second protruding member 24, and urges both the first protruding member 23 and the second protruding member 24 so as to protrude from the shaft member 21 along the axial direction O.

Outer Block

The outer block 30 is a member that is coupled with the inner block 40 to house the spring rod 20. In this embodiment, the outer block 30 is formed by performing processing such as cutting on a pure metal material, and includes the first arm portion 31, the second arm portion 32, and a body portion 33.

The first arm portion 31 is provided on a first end portion side of the body portion 33. The first arm portion 31 is provided with the first arm recessed portion 311 and a first arm fixing hole 312.

The first arm recessed portion 311 is a recessed portion in which the shaft member 21 of the spring rod 20 is disposed, and is provided along the axial direction O of the shaft member 21. In this embodiment, the first arm recessed portion 311 is provided so as to extend from the first side surface 313 to the second side surface 314 of the first arm portion 31. Further, the first arm recessed portion 311 is provided so as to open to the back surface side of the watch 100 when the strap 1 is attached to the watch main body 110. Note that the first arm recessed portion 311 is an example of a first recessed portion of the present disclosure.

The first arm fixing hole 312 is a hole into which the fixing member 50 is inserted, and is provided along an axial direction of a pin 51 of the fixing member 50, which will be described below. In this embodiment, the first arm fixing hole 312 includes a large diameter portion 3121 and a small diameter portion 3122 having a diameter smaller than that of the large diameter portion 3121, and penetrates the first arm portion 31 from the first side surface 313 to the second side surface 314. Then, one of C-rings 52 of the fixing member 50, which will be described below, is disposed in the large diameter portion 3121.

Furthermore, in this embodiment, a curved portion 315, which is cut into a spherical shape, is formed in an end portion of the first arm portion 31 on the strap main body 2 side. The curved portion 315 is formed in accordance with a spherical surface of the decorative member 3. As a result, when a corner portion of the first arm portion 31 comes into contact with the decorative member 3, chipping of the corner portion of the first arm portion 31 can be suppressed.

The second arm portion 32 is provided on a second end portion side of the body portion 33. In other words, the first arm portion 31 and the second arm portion 32 are disposed sandwiching the body portion 33.

The second arm portion 32 is provided with the second arm recessed portion 321, the second arm insertion hole 322, and a second arm fixing hole 323.

The second arm recessed portion 321 is a recessed portion in which the shaft member 21 of the spring rod 20 is disposed, and is provided along the axial direction O of the shaft member 21. In this embodiment, the second arm recessed portion 321 is provided so as to extend from a first side surface 324 of the second arm portion 32 to the vicinity of the center of the second arm portion 32. Further, the second arm recessed portion 321 is provided at a position corresponding to the inner block recessed portion 41 of the inner block 40, which will be described below, that is, at a position adjacent to the inner block recessed portion 41. Furthermore, the second arm recessed portion 321 is provided so as to open to the back surface side of the watch 100 when the strap 1 is attached to the watch main body 110.

The second arm insertion hole 322 is a hole through which the shaft member 21 of the spring rod 20 is inserted, and is provided along the axial direction O of the shaft member 21. In this embodiment, the second arm insertion hole 322 is communicated with the second arm recessed portion 321, and penetrates the second arm portion 32 from the second arm recessed portion 321 to the second side surface 325 of the second arm portion 32. Note that the second arm insertion hole 322 is an example of a first insertion hole of the present disclosure.

The second arm fixing hole 323 is a hole into which the fixing member 50 is inserted, and is provided along the axial direction of the pin 51 of the fixing member 50, which will be described below. In this embodiment, the second arm fixing hole 323 penetrates the second arm portion 32 from the first side surface 324 to the second side surface 325 of the second arm portion 32. Then, another of the C-rings 52 of the fixing member 50, which will be described below, is disposed in the second arm fixing hole 323.

Furthermore, in this embodiment, a curved portion 326, which is cut into a spherical shape, is formed in an end portion of the second arm portion 32 on the strap main body 2 side. The curved portion 326 is formed in accordance with the spherical surface of the decorative member 3. As a result, when a corner portion of the second arm portion 32 comes into contact with the decorative member 3, chipping of the corner portion of the second arm portion 32 can be suppressed.

The body portion 33 includes a first body plate portion 331 and a second body plate portion 332 extending in a direction intersecting the first body plate portion 331, and has an L-shape in a cross-sectional view. As described above, the first arm portion 31 is disposed on the first end portion side of the body portion 33, the second arm portion 32 is disposed on the second end portion side of the body portion 33, and the body portion 33 couples the first arm portion 31 and the second arm portion 32.

Further, in this embodiment, the body portion 33 is configured such that, when the strap 1 is attached to the watch main body 110, the second body plate portion 332 covers the inner block 40 and the connecting rings 4 in plan view seen from a direction perpendicular to the surface of the second body portion 332 substantially parallel to the longitudinal direction of the strap 1. As a result, the connecting rings 4 can be concealed, and it is thus possible to inhibit the design of the strap 1 from being compromised due to exposure of the connecting rings 4. Note that the second body plate portion 332 is an example of a covering portion of the present disclosure.

Inner Block

The inner block 40 is a member that is coupled with the outer block 30 to house the spring rod 20, and is disposed between the first arm portion 31 and the second arm portion 32 by the fixing member 50. In this embodiment, the inner block 40 is formed by performing processing such as cutting on a pure metal material, and two portions of the inner block 40 located on a side facing the decorative members 3 are cut out.

The inner block 40 is provided with the inner block recessed portion 41, the inner block insertion hole 42, and an inner block fixing hole 43.

The inner block recessed portion 41 is a recessed portion in which the shaft member 21 of the spring rod 20 is disposed, and is provided along the axial direction O of the shaft member 21. In this embodiment, the inner block recessed portion 41 is provided from a side surface 46 of the inner block 40 toward the center of the inner block 40. Further, the inner block recessed portion 41 is provided adjacent to the second arm recessed portion 321 of the second arm portion 32. Furthermore, the inner block recessed portion 41 is provided so as to open to the back surface side of the watch 100 when the strap 1 is attached to the watch main body 110.

Note that the inner block recessed portion 41 is an example of a second recessed portion of the present disclosure.

The inner block insertion hole 42 is a hole through which the shaft member 21 of the spring rod 20 is inserted, and is provided along the axial direction O of the shaft member 21. In this embodiment, the inner block insertion hole 42 is provided at a position corresponding to the first arm recessed portion 311, that is, at a position adjacent to the first arm recessed portion 311. Further, the inner block insertion hole 42 is provided so as to extend from a side surface 45 of the inner block 40 to the inner block recessed portion 41. In other words, the inner block insertion hole 42 and the inner block recessed portion 41 are communicated with each other.

In this manner, in this embodiment, the first arm recessed portion 311, the inner block insertion hole 42, the inner block recessed portion 41, the second arm recessed portion 321, and the second arm insertion hole 322 are arranged in this order along the axial direction O. Note that the inner block insertion hole 42 is an example of a second insertion hole of the present disclosure.

The inner block fixing hole 43 is a hole into which the fixing member 50 is inserted, is provided along the axial direction O of the pin 51 of the fixing member 50, which will be described below, and penetrates the inner block 40.

Furthermore, in this embodiment, a first curved portion 48 and a second curved portion 49, each of which is cut into a spherical shape, are formed in an end portion of the inner block 40 on the strap main body 2 side. The first curved portion 48 and the second curved portion 49 are each formed in accordance with the spherical surface of the decorative member 3. As a result, when the inner block 40 comes into contact with the decorative member 3, chipping of a corner portion of the inner block 40 can be suppressed.

Fixing Member

The fixing member 50 is a member for fixing the inner block 40 between the first arm portion 31 and the second arm portion 32 of the outer block 30, and for coupling the coupler 10 and the strap main body 2. In this embodiment, the fixing member 50 includes the pin 51 and the C-rings 52.

The pin 51 is formed of metal and is inserted into the first arm fixing hole 312, the connecting rings 4, the inner block fixing hole 43, and the second arm fixing hole 323. Further, the pin 51 is configured such that the outer diameter thereof is substantially equal to the inner diameter of the small diameter portion 3122 of the first arm fixing hole 312 and the inner diameter of the inner block fixing hole 43.

The C-rings 52 are each constituted by metal such as stainless steel, and as described above, are disposed in the large diameter portion 3121 of the first arm fixing hole 312 and the second arm fixing hole 323. Then, the pin 51 is inserted into the C-rings 52.

Note that the first arm fixing hole 312, the inner block fixing hole 43, and the second arm fixing hole 323 configure a fixing member insertion hole of the present disclosure through which the fixing member 50 is inserted.

Connecting Ring Arrangement Portion

The connecting ring arrangement portion 60 is an arrangement portion in which the connecting ring 4 is disposed. In this embodiment, the connecting ring arrangement portions 60 are constituted by two gaps between the outer block 30 and the inner block 40. Specifically, the connecting ring arrangement portions 60 are constituted by a gap between the first arm portion 31 and the cut-out portion of the inner block 40, and a gap between the second arm portion 32 and the cut-out portion of the inner block 40.

Method for Assembling Strap 1

Next, a method for assembling the strap 1 will be described.

Figure 6:
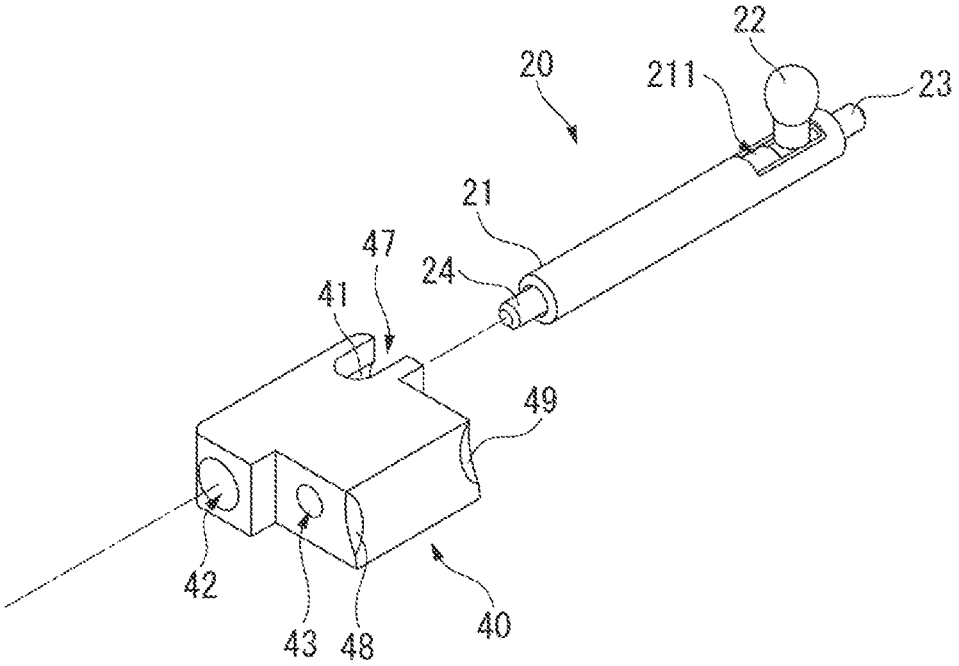
FIG. 6 is a perspective view illustrating a method for assembling the strap according to the first embodiment.
Figure 7:
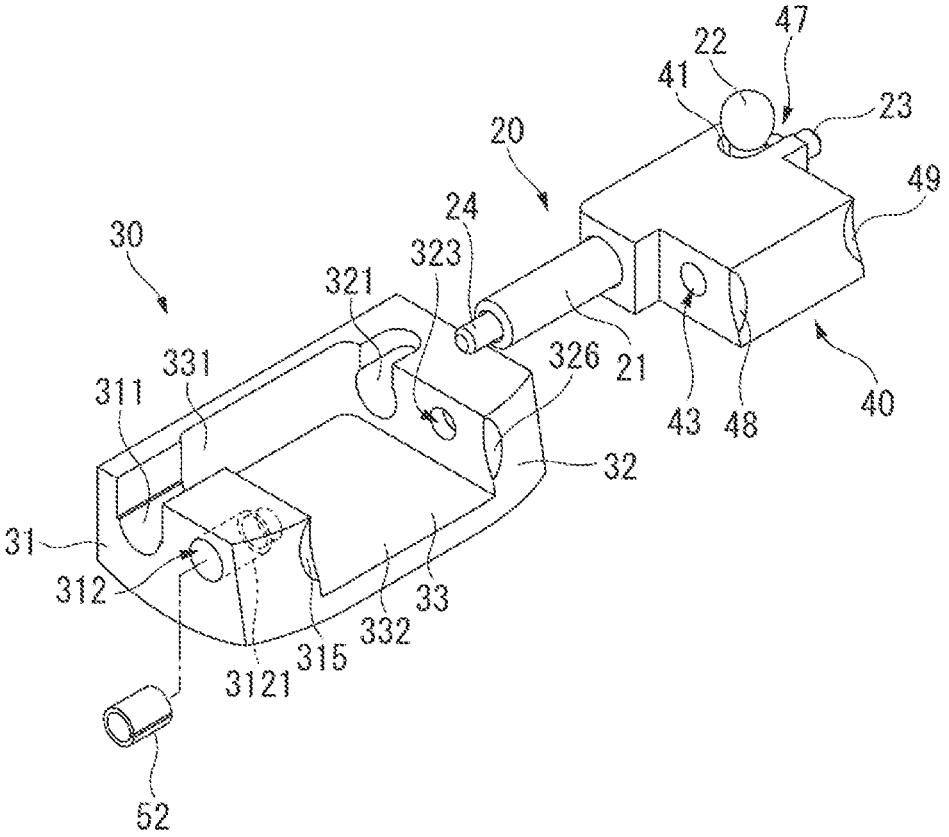
FIG. 7 is a perspective view illustrating the method for assembling the strap according to the first embodiment.
Figure 8:
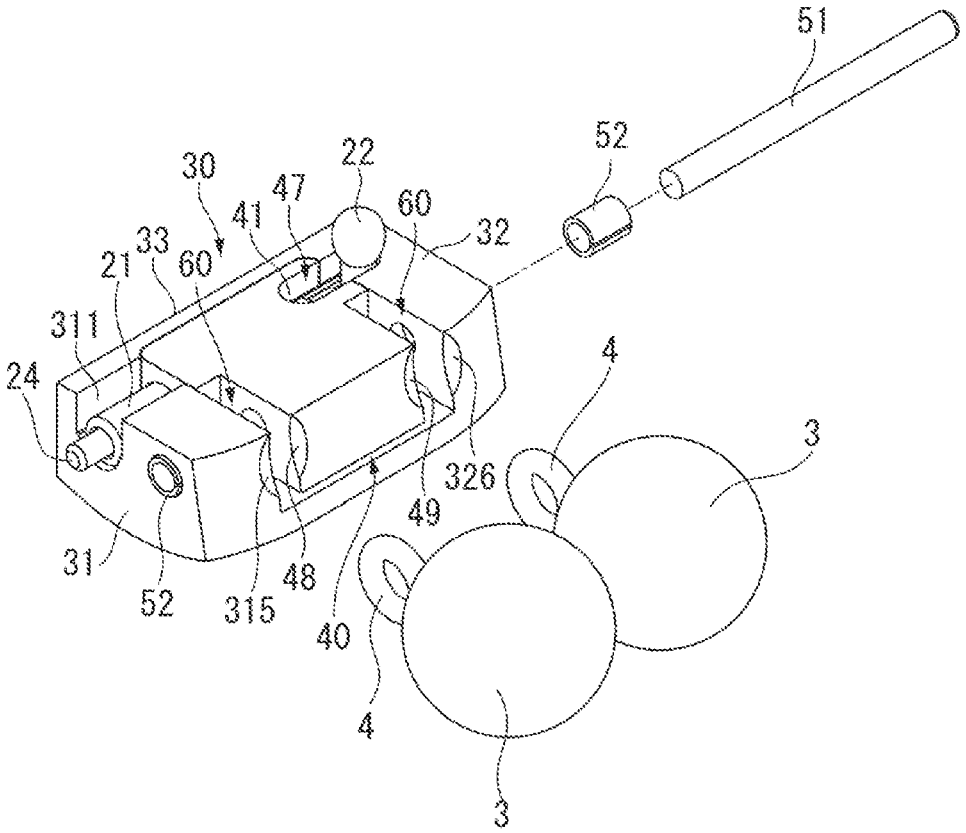
FIG. 8 is a perspective view illustrating the method for assembling the strap according to the first embodiment.

FIG. 6 to FIG. 8 are perspective views illustrating the method for assembling the strap 1.

First, as illustrated in FIG. 6, the shaft member 21 of the spring rod 20 is inserted through the inner block insertion hole 42 of the inner block 40. As a result, the spring rod 20 is disposed in the inner block recessed portion 41 and the inner block insertion hole 42 of the inner block 40. At this time, the spring rod 20 is disposed so that the operating portion 22 protrudes from the opening 47 of the inner block recessed portion 41.

Next, as illustrated in FIG. 7, the operating portion 22 of the spring rod 20 is moved along the axial direction O, and the operating portion 22 is engaged with the inner block 40. Then, the C-ring 52 is disposed in the large diameter portion 3121 of the first arm fixing hole 312.

In this state, the inner block 40 is disposed between the first arm portion 31 and the second arm portion 32 of the outer block 30. At this time, the shaft member 21 of the spring rod 20 is disposed in the first arm recessed portion 311 of the first arm portion 31.

Further, at this time, the first protruding member 23 is disposed in the second arm recessed portion 321. In other words, the inner block recessed portion 41 is formed such that the tip end portion of the first protruding member 23 protrudes from the side surface 46 of the inner block 40 when the operating portion 22 is engaged with the inner block 40.

As a result, since the first protruding member 23 does not interfere with the second arm portion 32 in the state in which the first protruding member 23 protrudes from the side surface 46 of the inner block 40, the inner block 40 can be disposed between the first arm portion 31 and the second arm portion 32.

Next, as illustrated in FIG. 8, the operating portion 22 of the spring rod 20 is moved along the axial direction O, and the shaft member 21 is inserted through the second arm insertion hole 322 of the second arm portion 32. As a result, for example, when the operating portion 22 is moved toward the first arm portion 31 side, at a stage at which the operating portion 22 has been moved by a predetermined amount, the operating portion 22 interferes with the inner block 40. Further, when the shaft member 21 is moved toward the second arm portion 32 side, at the stage at which the operating portion 22 has been moved by the predetermined amount, the operating portion 22 interferes with the second arm portion 32. Thus, when the operating portion 22 is moved along the axial direction O, it is possible to inhibit the spring rod 20 from becoming disengaged from the outer block 30 and the inner block 40.

Next, the connecting rings 4 of the strap main body 2 are disposed in the connecting ring arrangement portions 60, and the C-ring 52 is inserted into the second arm fixing hole 323.

Then, finally, the pin 51 is inserted into the first arm fixing hole 312, the connecting rings 4, the inner block fixing hole 43, and the second arm fixing hole 323. In this way, the pin 51 is pressed into the large diameter portion 3121 of the first arm fixing hole 312 and the C-ring 52 disposed in the second arm fixing hole 323, and the C-ring 52 deforms toward the outer circumferential side. As a result, the C-ring 52 is engaged with the large diameter portion 3121 of the first arm fixing hole 312 and the second arm fixing hole 323, and the pin 51 is stopped from becoming disengaged from the first arm fixing hole 312, the connecting rings 4, the inner block fixing hole 43, and the second arm fixing hole 323. Thus, the inner block 40 is fixed to the outer block 30 by the fixing member 50, and the strap main body 2 is coupled to the coupler 10.

Rotation Regulating Structure

Next, a rotation regulating structure of the strap 1 will be described.

As illustrated in FIG. 3, in this embodiment, when the strap 1 is viewed in a cross-sectional view seen from the axial direction of the pin 51, the coupler 10 is configured such that a distance R of a normal line of the second body plate portion 332 from the second body plate portion 332 of the body portion 33 to the axial center of the pin 51 of the fixing member 50 is shorter than a distance L from the axial center of the pin 51 to an end portion of the inner block 40 on the decorative member 3 side. More specifically, the distance L is a distance from a point at which an imaginary line, which connects the axial center of the pin 51 and an end portion of the second body plate portion 332 on the decorative member 3 side, and the front surface of the inner block 40 intersect each other, to the axial center of the pin 51. Further, in plan view, the second body plate portion 332 covers the inner block 40. As a result, rotation of the inner block 40 with respect to the outer block 30 about the pin 51 of the fixing member 50 is regulated by the second body plate portion 332, the pin 51 serving as the rotary shaft. Thus, when the strap 1 is removed from the watch main body 110, it is possible to prevent the spring rod 20 from becoming disengaged from the outer block 30 and the inner block 40 as a result of the inner block 40 rotating with respect to the outer block 30.

Note that the structure of the coupler 10 in which the distance R of the normal line of the second body plate portion 332 from the second body plate portion 332 to the axial center of the pin 51 is made shorter than the distance L from the axial center of the pin 51 to the end portion of the inner block 40 on the decorative member 3 side is an example of a rotation regulating structure of the present disclosure.

Advantageous Effects of First Embodiment

According to the first embodiment described above, the following advantageous effects can be obtained.

In this embodiment, the strap main body 2 including the plurality of decorative members 3 is connected to the coupler 10 by the fixing member 50. Then, the above-described coupler 10 to which the strap main body 2 is connected can be easily connected to the watch main body 110 by the spring rod 20. Thus, as well as the strap 1 of the present disclosure, another strap that is coupled using a generic spring rod can also be used.

Further, in this embodiment, by removing the fixing member 50, the strap main body 2 can be removed from the coupler 10. Thus, maintenance and the like of the decorative members 3 can be made easy.

In this embodiment, the coupler 10 covers the connecting ring 4.

As a result, when the strap 1 is attached to the watch main body 110, the connecting rings 4 can be concealed, and it is thus possible to inhibit the design of the strap 1 from being compromised due to the exposure of the connecting rings 4.

In this embodiment, the spring rod 20 is disposed so as to pass through the first arm recessed portion 311, the inner block insertion hole 42, the inner block recessed portion 41, and the second arm insertion hole 322, and so that the operating portion 22 protrudes from the opening 47 of the inner block recessed portion 41. Further, the spring rod 20 is configured so that the operating portion 22 is movable in the axial direction O while being housed in the outer block 30 and the inner block 40.

As a result, when the operating portion 22 is moved along the axial direction O, it is possible to inhibit the spring rod 20 from becoming disengaged from the outer block 30 and the inner block 40.

Further, since a disengagement prevention structure of the spring rod 20 can be achieved without bending a portion of a metal component, the outer block 30 and the inner block 40 constituting the disengagement prevention structure can be manufactured from a pure metal material. Thus, the strap 1 that can incorporate the spring rod 20 including the operating portion, and that can have an excellent design and a luxurious feel can be obtained.

In this embodiment, when the operating portion 22 of the spring rod 20 is moved to the inner block recessed portion 41 and the strap 1 is removed from the watch main body 110, since the rotation of the inner block 40 with respect to the outer block 30 is regulated by the rotation regulating structure, it is possible to prevent the spring rod 20 from becoming disengaged from the outer block 30 and the inner block 40.

In this embodiment, the rotation regulating structure is constituted by making the distance R of the normal line of the second body plate portion 332 from the second body plate portion 332 to the axial center of the fixing member 50 shorter than the distance L from the axial center of the fixing member 50 to the end portion of the inner block 40 on the decorative member 3 side. As a result, without separately adding a component for regulating the rotation of the inner block 40, the rotation of the inner block 40 can be regulated by the second body plate portion 332. Thus, the number of components can be reduced.

Second Embodiment

Next, a strap 1A according to a second embodiment of the present disclosure will be described with reference to the drawings.

The strap 1A of the second embodiment differs from the first embodiment described above in that decorative members 3A are coupled to each other by wires 5A so as to be arranged in three rows. Note that, in the second embodiment, components that are identical or similar to the corresponding components of the first embodiment will be denoted by the same reference signs, and descriptions of these components will be omitted.

Figure 9:
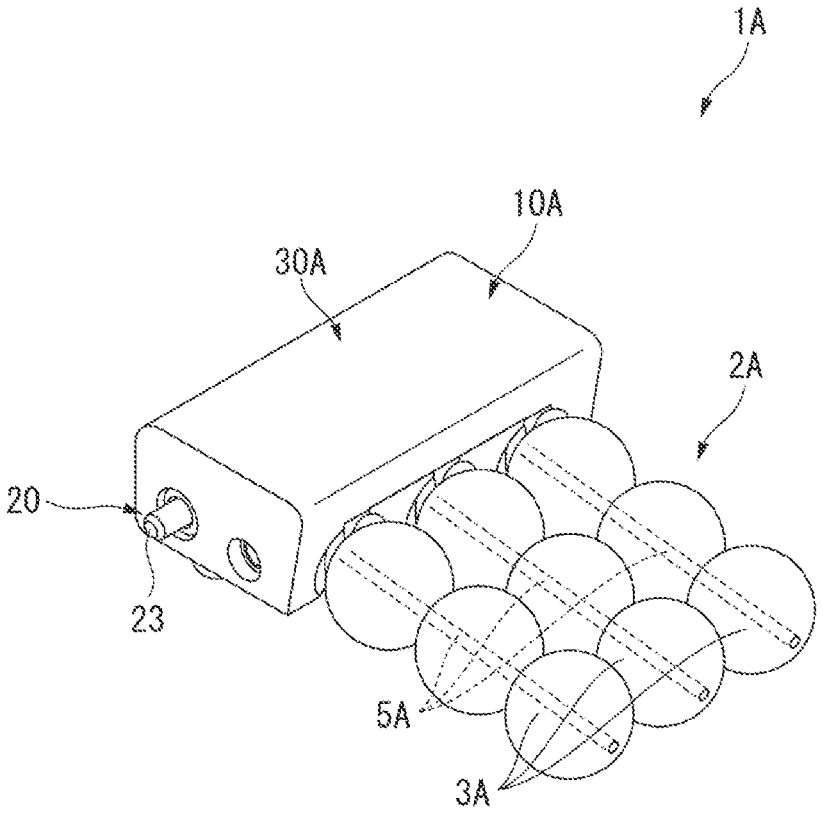
FIG. 9 is a perspective view illustrating a strap according to a second embodiment.
Figure 10:
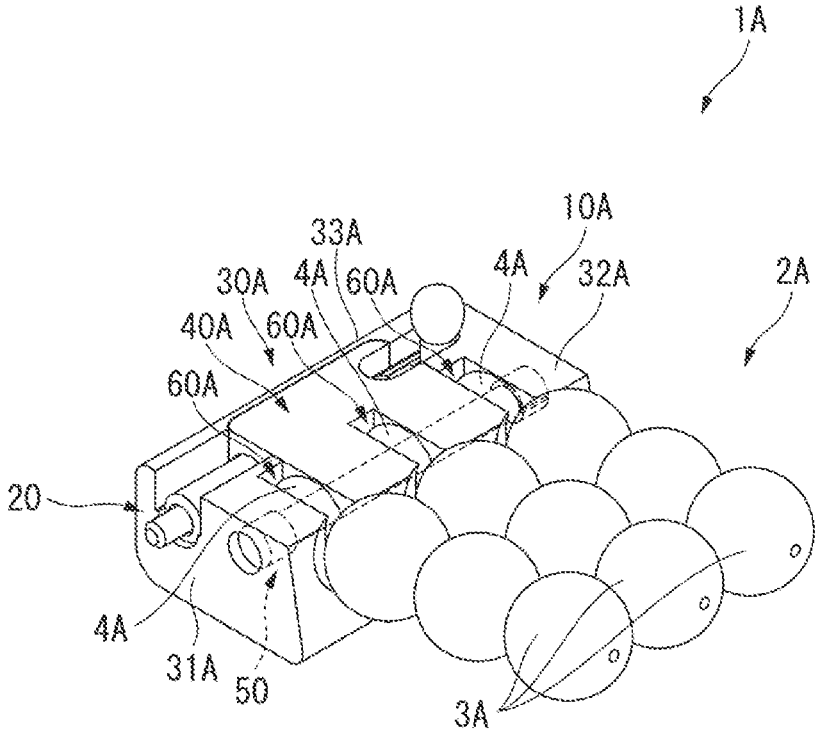
FIG. 10 is a perspective view illustrating the strap according to the second embodiment.

FIG. 9 and FIG. 10 are perspective views illustrating the strap 1A of the second embodiment. Note that in FIG. 9 and FIG. 10, the strap 1A is viewed from different directions.

As illustrated in FIG. 9 and FIG. 10, similarly to the first embodiment described above, the strap 1A includes a strap main body 2A constituted by the plurality of decorative members 3A being coupled to each other by the wires 5A, and a coupler 10A coupled to both end portions of the strap main body 2A.

Band Main Body

The strap main body 2A is a main body portion of the strap 1A similarly to the first embodiment described above, and includes the plurality of decorative members 3A, connecting rings 4A, and the wires 5A.

The decorative members 3A are each constituted by a pearl similarly to the first embodiment described above, and are coupled to each other by the wires 5A each constituted by a piano wire or the like. In this embodiment, the decorative members 3A are coupled to each other by the wires 5A so as to be arranged in three rows.

Then, the connecting rings 4A are coupled to both end portions of the decorative members 3A by the wires 5A. Specifically, three of the connecting rings 4A are coupled to a first end portion of the strap main body 2A, and three of the connecting rings 4A are coupled to a second end portion of the strap main body 2A.

Coupler

The coupler 10A includes the spring rod 20, an outer block 30A, an inner block 40A, the fixing member 50, and connecting ring arrangement portions 60A.

Outer Block

The outer block 30A includes a first arm portion 31A, a second arm portion 32A, and a body portion 33A similarly to the first embodiment described above.

In this embodiment, the first arm portion 31A and the second arm portion 32A are formed as a result of respective end portions of the first arm portion 31A and the second arm portion 32A, on the side facing the decorative members 3A, being cut out. Then, the connecting ring arrangement portions 60A are constituted by a gap between the cut-out portion of the first arm portion 31A and the inner block 40A, and a gap between the cut-out portion of the second arm portion 32A and the inner block 40A.

Inner Block

The inner block 40A is disposed between the first arm portion 31A and the second arm portion 32A similarly to the first embodiment described above. In this embodiment, the inner block 40A is formed as a result of a portion thereof on the side facing the decorative members 3A being cut out. Then, the connecting ring arrangement portion 60A is constituted by a gap formed by the cut-out portion of the inner block 40A.

Advantageous Effects of Second Embodiment

According to the second embodiment described above, the following advantageous effects can be obtained.

In this embodiment, the decorative members 3A are coupled to each other by the wires 5A so as to be arranged side by side in three rows. Thus, variations in the design of the strap 1A can be increased.

Third Embodiment

Next, a strap 1B according to a third embodiment of the present disclosure will be described with reference to the drawings.

The strap 1B of the third embodiment differs from the first and second embodiments described above in that a coupler 10B is constituted by an end-piece 70B constituted by a single member. Note that, in the third embodiment, components that are identical or similar to the corresponding components of the first and second embodiment will be denoted by the same reference signs, and descriptions of these components will be omitted.

Figure 11:
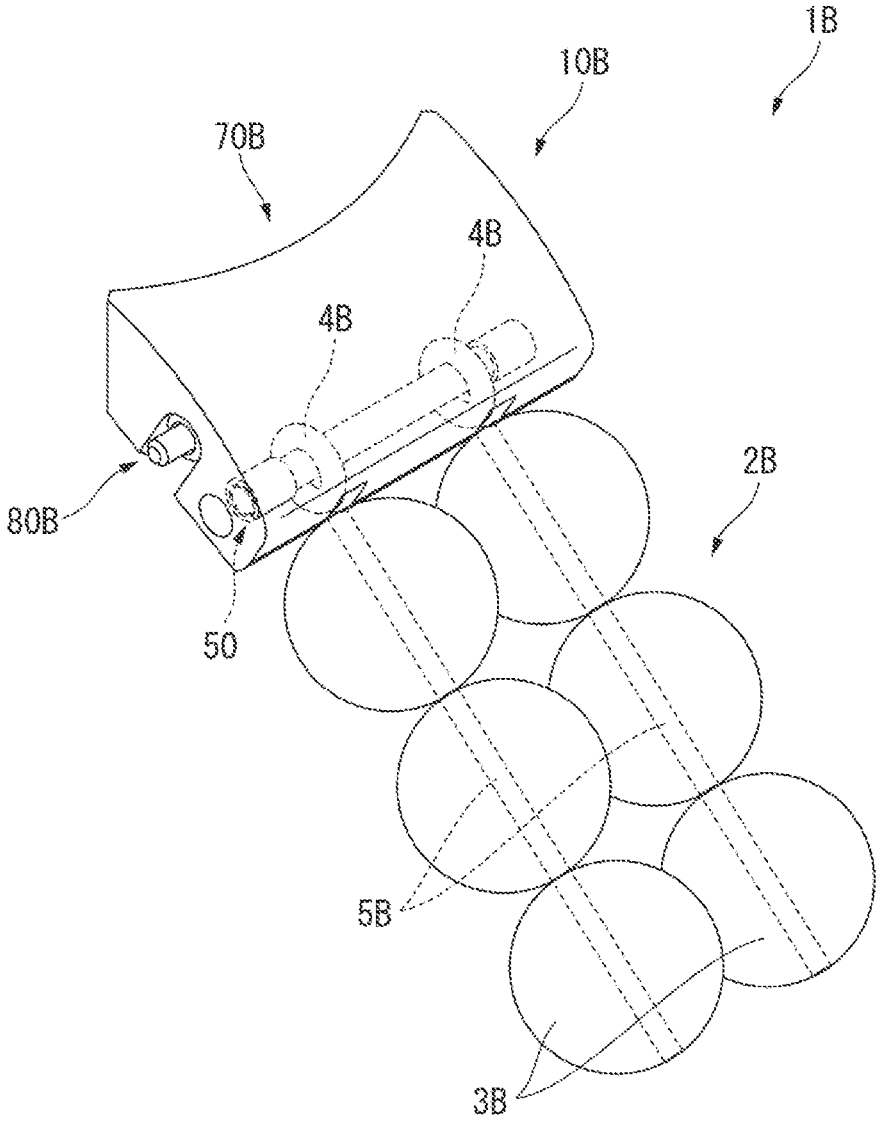
FIG. 11 is a perspective view illustrating a strap according to a third embodiment.
Figure 12:
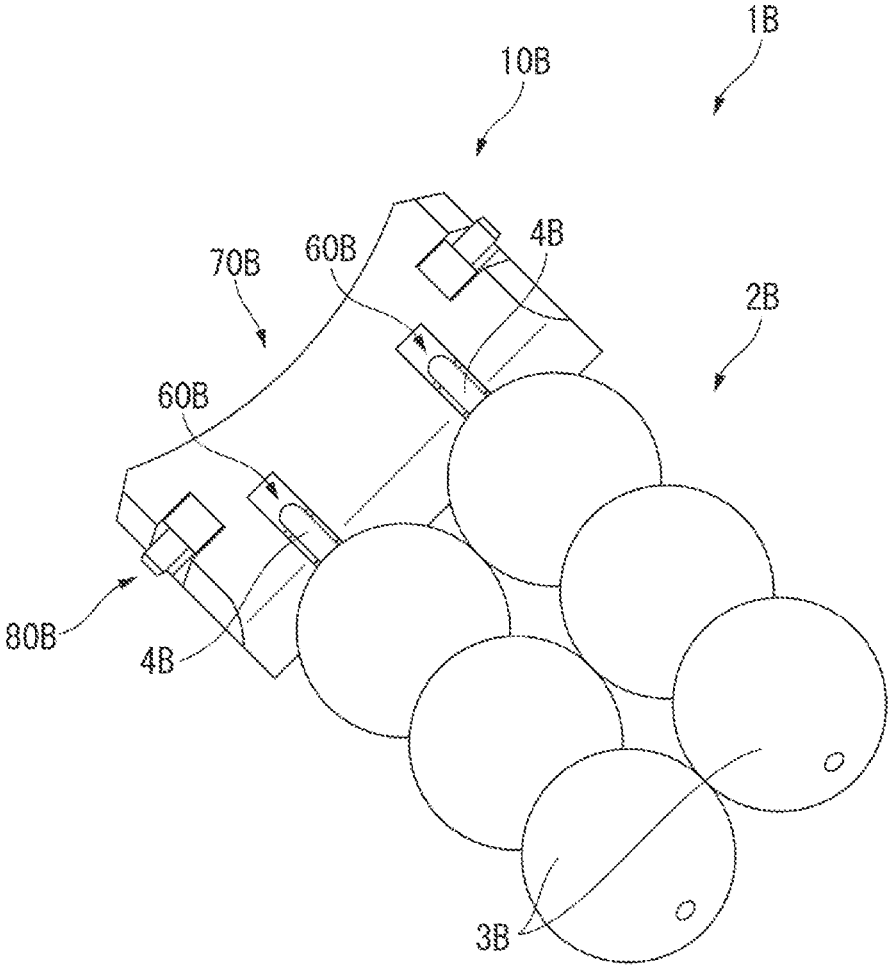
FIG. 12 is a perspective view illustrating the strap according to the third embodiment.

FIG. 11 and FIG. 12 are perspective views illustrating the strap 1B of the third embodiment. Note that in FIG. 11 and FIG. 12, the strap 1B is viewed from different directions.

As illustrated in FIG. 11 and FIG. 12, similarly to the first embodiment described above, the strap 1B includes a strap main body 2B constituted by a plurality of decorative members 3B being coupled to each other by wires 5B, and a coupler 10B coupled to both end portions of the strap main body 2B.

Strap Main Body

The strap main body 2B is a main body portion of the strap 1B similarly to the first embodiment described above, and includes the plurality of decorative members 3B, connecting rings 4B, and the wires 5B.

The decorative members 3B are each constituted by a pearl similarly to the first embodiment described above, and coupled to each other by the wires 5B each constituted by a piano wire or the like. In this embodiment, the decorative members 3 are coupled to each other by the wires 5B so that the decorative members 3 are arranged in two rows.

Then, in this embodiment, the connecting rings 4B are disposed in connecting ring arrangement portions 60B of the coupler 10B, and coupled to the coupler 10B by the fixing member 50. As a result, the strap main body 2B and the coupler 10B are coupled to each other.

Coupler

The coupler 10B includes the end-piece 70B, a spring rod 80B, the fixing member 50, and the connecting ring arrangement portions 60B.

End-piece

The end-piece 70B is a member for housing the spring rod 80B. In this embodiment, the end-piece 70B is formed by the single member as a result of performing processing such as cutting on a pure metal material, and two portions thereof on the side facing the decorative members 3B are cut out. Then, the connecting ring arrangement portions 60B are constituted by gaps formed by the cut-out portions of the end-piece 70B.

Furthermore, in this embodiment, a portion of the end-piece 70B on the side facing the watch main body 110 is cut into a curved shape that matches the shape of the watch main body 110.

Spring Rod

The spring rod 80B is a generic spring rod constituted by a shaft portion and protruding portions, and is housed in the end-piece 70B. Then, as a result of the protruding portions of the spring rod 80B being inserted into the holes 1121 provided in the holding piece portions 112A, 112B of the watch main body 110, the strap 1B is coupled to the watch main body 110.

Advantageous Effects of Third Embodiment

According to the third embodiment described above, the following advantageous effects can be obtained.

In this embodiment, the coupler 10B for coupling the strap 1B to the watch main body 110 includes the end-piece 70B constituted by the single member. Thus, the strap main body 2B including the plurality of decorative members 3B can be coupled to the coupler 10B using the above-described end-piece 70B.

Modified Examples

Note that the present disclosure is not limited to each of the embodiments described above, and variations, modifications, and the like within the scope in which the object of the present disclosure can be achieved are included in the present disclosure.

In each of the embodiments described above, the coupler 10, 10A, 10B and the strap main body 2, 2A, and 2B are coupled to each other by the fixing member 50 provided with the pin 51 and the C-rings 52, but the present disclosure is not limited to this configuration. For example, the coupler and the fixing member may be coupled to each other by a screw or the like.

In the first and second embodiments, the connecting ring arrangement portions 60, 60A are constituted by the gaps between the outer block 30, 30A and the inner block 40, 40A, but the present disclosure is not limited to this configuration. For example, cut-out portions may be formed on the outer side of the first arm portion and the second arm portion of the outer block, and the connecting ring arrangement portions may be constituted by the cut-out portions. In other words, after disposing the connecting rings so as to sandwich the outer block, the connecting rings may be coupled by the fixing member.

In each of the embodiments described above, the coupler 10, 10A, 10B has the shape that entirely covers the connecting ring 4, but the present disclosure is not limited to this configuration. For example, the coupler 10, 10A, 10B may cover only a portion of the connecting ring 4, or may not cover the connecting ring 4 at all. For example, in the first and second embodiments, the body portion 33, 33A of the outer block 30, 30A may be formed only by the first body plate portion 331, and in the third embodiment, the connecting ring arrangement portion 60B may be formed by the end-piece 70B being cut out as far as the front surface thereof.

In each of the embodiments described above, the strap main body 2, 2A, 2B is formed so that the decorative members 3, 3A, 3B are arranged in two rows or three rows, but the decorative members may be arranged in one row or four or more rows.

Further, in each of the embodiments described above, the connecting ring 4, 4A, 4B is attached to each of the rows of the decorative members 3, 3A, 3B, but the present disclosure is not limited to this configuration. For example, a plurality of the rows of the decorative members may be attached to one of the connecting rings.

In each of the embodiments described above, the outer block 30, 30A, the inner block 40, 40A, and the end-piece 70B are formed of the pure metal material, but the present disclosure is not limited to this configuration. For example, these components may be formed of ceramic or resin. Further, the curved portion 315, 326, the first curved portion 48, and the second curved portion 49, which are cut into the spherical shape, are formed in the end portion, on the strap main body 2, 2A side, of the outer block 30, 30A and the inner block 40, 40A, but the present disclosure is not limited to this configuration. The curved portions need not necessarily be formed in the outer block 30, 30A and the inner block 40, 40A, and, for example, by interposing an interposing member, which is different from the decorative member, between the connecting ring and the decorative member, direct contact between an end-piece including the outer block 30, 30A and the inner block 40, 40A, and the decorative member may be prevented.

In the first and second embodiments, the second arm recessed portion 321, 321A is provided in the second arm portion 32, 32A, but the present disclosure is not limited to this configuration. For example, even a case where the second arm recessed portion is not provided in the second arm portion is included in the present disclosure. In this case, a movable range of the operating portion of the spring rod may be regulated by the inner block recessed portion and the second arm portion.

In each of the embodiments described above, the strap 1, 1A, 1B of the watch 100 is exemplified, but the present disclosure is not limited to this configuration. For example, the present disclosure can be applied to a wrist-worn device such as a pulse meter, or a strap attached to the wrist-worn device.

Summary of Present Disclosure

A strap of the present disclosure includes a spring rod including a shaft member, a strap main body including a plurality of decorative members coupled to each other by a thread-like member and a connecting ring coupled to an end portion of the plurality of decorative members, a coupler including a spring rod insertion hole through which the spring rod is inserted, a fixing member insertion hole, and a connecting ring arrangement portion in which the connecting ring is disposed, and configured to be coupled, by the spring rod, to a watch main body of a watch, and a fixing member configured to connect the strap main body and the coupler by being inserted through the fixing member insertion hole and the connecting ring.

As a result, the band main body including the plurality of decorative members is coupled to the coupler by the fixing member. Then, this type of coupler to which the band main body is coupled can be easily coupled to the watch main body by the spring rod. Thus, as well as the strap of the present disclosure, another strap that is coupled using a generic spring rod can also be used.

Further, by removing the fixing member, the strap main body can be removed from the coupler. Thus, maintenance and the like of the decorative members can be made easy.

In the strap of the present disclosure, the coupler may include a covering portion covering at least a portion of the connecting ring.

As a result, at least a portion of the connecting ring can be concealed, and it is thus possible to inhibit the design of the strap from being compromised due to exposure of the connecting ring.

In the strap of the present disclosure, the coupler may include an outer block including a first arm portion, a second arm portion, and a body portion that couples the first arm portion and the second arm portion, and an inner block disposed between the first arm portion and the second arm portion, the connecting ring arrangement portion being formed between the outer block and the inner block. A first recessed portion may be provided in the first arm portion along an axial direction of the shaft member, a first insertion hole constituting the spring rod insertion hole may be provided in the second arm portion along the axial direction, a second insertion hole constituting the spring rod insertion hole may be provided in the inner block along the axial direction, and a second recessed portion communicated with the second insertion hole may be provided in the inner block along the axial direction. The first recessed portion, the second insertion hole, the second recessed portion, and the first insertion hole may be arranged in this order along the axial direction, and the spring rod may include an operating portion and a protruding member, the spring rod being inserted through the first recessed portion, the second insertion hole, the second recessed portion, and the first insertion hole and being disposed with the operating portion protruding from an opening of the second recessed portion, and the operating portion being configured to be movable in the axial direction in this state.

As a result, when the operating portion is moved along the axial direction, it is possible to inhibit the spring rod from becoming disengaged from the outer block and the inner block.

Further, since a disengagement prevention structure of the spring rod can be achieved without bending a portion of a metal component, the outer block and the inner block constituting the disengagement prevention structure can be manufactured from a pure metal material. Thus, the strap that can have an excellent design and a luxurious feel can be obtained.

In the strap of the present disclosure, the coupler may include a rotation regulating structure configured to regulate rotation of the inner block with respect to the outer block with the fixing member serving as a rotary shaft.

As a result, when the strap is removed from the watch main body, since the rotation of the inner block with respect to the outer block is regulated by the rotation regulating structure, it is possible to prevent the spring rod from becoming disengaged from the outer block and the inner block.

In the strap of the present disclosure, the body portion may include a first body plate portion, and a second body plate portion extending in a direction intersecting the first body plate portion and covering the inner block, and the rotation regulating structure may be constituted by causing a distance of a normal line of the second body plate portion from the second body plate portion to a center of the fixing member to be shorter than a distance from the center of the fixing member to an end portion of the inner block on a side of the decorative members.

As a result, without separately adding a component for regulating the rotation of the inner block, the rotation of the inner block can be regulated by the second body plate portion. Thus, the number of components can be reduced.

A watch of the present disclosure includes the strap.

What is claimed is:

1. A strap comprising:

a spring rod including a shaft member, the shaft member extending along a first direction;

a strap main body including a plurality of pearls coupled to each other by a thread-like member and a connecting ring coupled to an end portion of the plurality of pearls;

a coupler including a spring rod insertion hole through which the spring rod is inserted, a fixing member insertion hole, and a connecting ring arrangement portion in which the connecting ring is disposed, and configured to be coupled, by the spring rod, to a watch main body of a watch; and a fixing member configured to connect the strap main body and the coupler by being inserted through the fixing member insertion hole and the connecting ring, the fixing member being bar-shaped and extending along the first direction.

2. A watch comprising:

the strap according to claim 1.

3. A strap comprising:

a spring rod including a shaft member, the shaft member extending along a first direction;

a strap main body including a plurality of decorative members coupled to each other and a connecting ring coupled to an end portion of the plurality of decorative members;

a coupler including a spring rod insertion hole through which the spring rod is inserted, a fixing member insertion hole, and a connecting ring arrangement portion in which the connecting ring is disposed, and configured to be coupled, by the spring rod, to a watch main body of a watch; and a fixing member configured to connect the strap main body and the coupler by being inserted through the fixing member insertion hole and the connecting ring, the fixing member being bar-shaped and extending along the first direction.

4. The strap according to claim 3, wherein the coupler includes a covering portion covering at least a portion of the connecting ring.

5. The strap according to claim 3, wherein the coupler includes an outer block including a first arm portion, a second arm portion, and a body portion that couples the first arm portion and the second arm portion, and an inner block disposed between the first arm portion and the second arm portion, the connecting ring arrangement portion is formed between the outer block and the inner block, a first recessed portion is provided in the first arm portion along an axial direction of the shaft member, a first insertion hole constituting the spring rod insertion hole is provided in the second arm portion along the axial direction, a second insertion hole constituting the spring rod insertion hole is provided in the inner block along the axial direction, a second recessed portion communicated with the second insertion hole is provided in the inner block along the axial direction, the first recessed portion, the second insertion hole, the second recessed portion, and the first insertion hole are arranged in this order along the axial direction, the spring rod includes an operating portion and a protruding member, and the operating portion is configured to be movable in the axial direction when the spring rod being inserted through the first recessed portion, the second insertion hole, the second recessed portion, and the first insertion hole and being disposed with the operating portion protruding from an opening of the second recessed portion.

6. The strap according to claim 5, wherein the coupler includes a rotation regulating structure configured to regulate rotation of the inner block with respect to the outer block with the fixing member serving as a rotary shaft.

7. The strap according to claim 6, wherein the body portion includes a first body plate portion, and a second body plate portion extending in a direction intersecting the first body plate portion and covering the inner block, and the rotation regulating structure is constituted by causing a distance of a normal line of the second body plate portion from the second body plate portion to a center of the fixing member to be shorter than a distance from the center of the fixing member to an end portion on the decorative members side of the inner block.

8. The strap according to claim 3, wherein the decorative member is formed of one of a pearl, a jewel, a shell, and wood.

9. The strap according to claim 3, wherein the decorative members are coupled to each other by a thread-like member.

10. The strap according to claim 9, wherein the connecting ring is formed of a member separate from the thread-like member.

11. The strap according to claim 9, wherein the connecting ring is formed integrally with the thread-like member.

12. The strap according to claim 9, wherein the thread-like member is one of a wire, a piano wire, a synthetic fiber, and a silk thread.

13. A watch comprising:

the strap according to claim 3.

* * * * *